United States Patent [19]

Ben-Dosa

[11] Patent Number: 4,865,121

[45] Date of Patent: Sep. 12, 1989

[54] CLEANING SYSTEM FOR FLUID-CONDUCTING TUBING

[76] Inventor: Chaim Ben-Dosa, Shirat Geulim Street 13, Herzliya, Israel

[21] Appl. No.: 81,687

[22] Filed: Aug. 5, 1987

[30] Foreign Application Priority Data

Aug. 29, 1986 [IL] Israel ..... 79885

[51] Int. Cl.[4] ..... F28G 1/12

[52] U.S. Cl. ..... 165/95; 15/3.5

[58] Field of Search ..... 165/95; 122/379, 395; 15/3.51, 3.52; 134/8

[56] References Cited

U.S. PATENT DOCUMENTS 2,948,143 8/1960 Prutt ..... 15/3.51
3,919,732 11/1975 Honma et al. ..... 165/95
4,556,102 12/1985 Bochinski et al. ..... 165/95

FOREIGN PATENT DOCUMENTS 0148509 7/1985 European Pat. Off. ..... 165/95

*Primary Examiner*—James C. Yeung
*Attorney, Agent, or Firm*—Benjamin J. Barish

[57] ABSTRACT

A cleaning system for cleaning tubing used for conducting a fluid therethrough, which system includes balls circulated with the fluid through the tubing from its upstream side to its downstream side, means for separating the balls from the fluid at the downstream side of the tubing, and recirculating means for recirculating the balls back to the upstream side of the tubing. The recirculating means comprises a chamber; a first passageway from the chamber to the downstream side of the tubing where the balls are separated from the fluid; a second passageway from the chamber to a point of lower pressure than that at the downstream side of the tubing; a valve in the second passageway effective when opened to produce, by the difference in pressure between the downstream side of the tubing and the point of lower pressure, a flow of the fluid and balls from the downstream side of the tubing to the chamber; a separator between the chamber and the second passageway to permit the fluid, but not the balls, to flow through the second passageway to the point of lower pressure; and an ejector for ejecting the balls collected in the chamber to the upstream side of the tubing.

18 Claims, 4 Drawing Sheets

FIG 3a
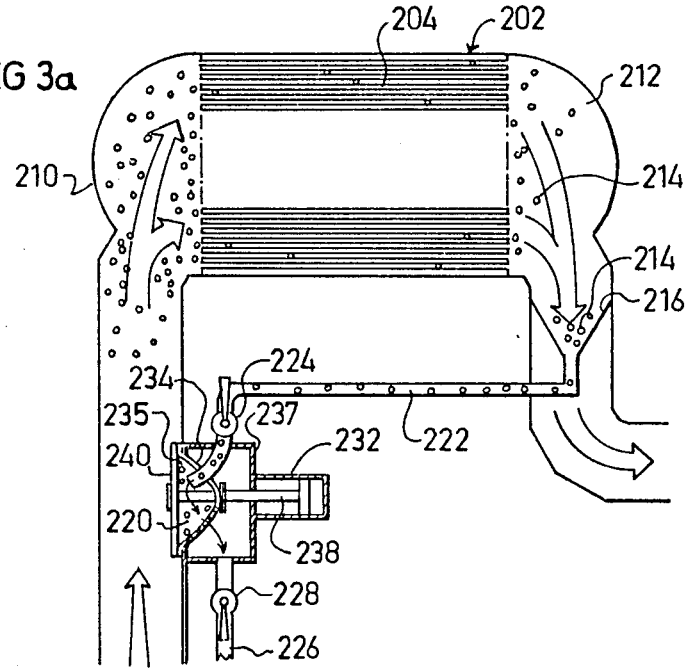
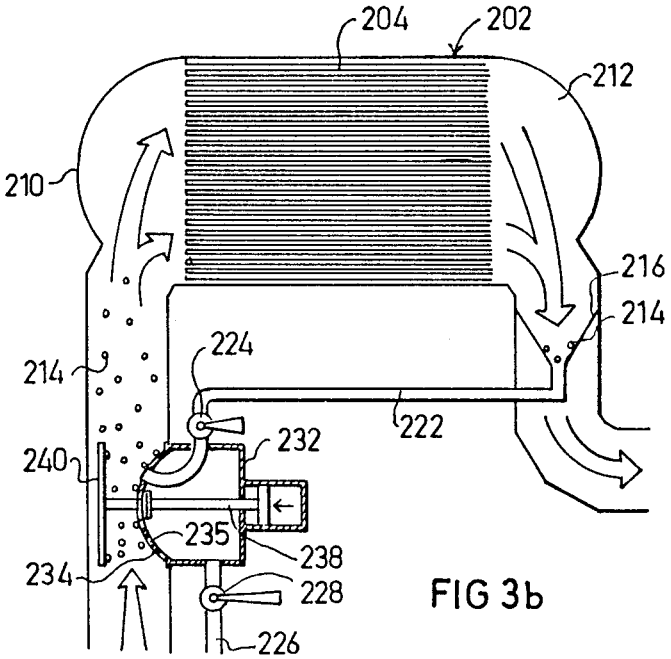
FIG 3b

FIG 4a
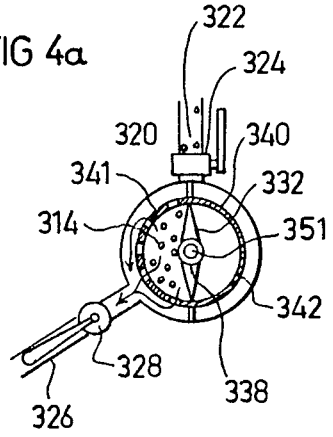
FIG 4b
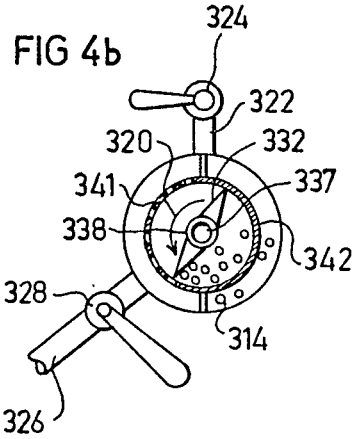
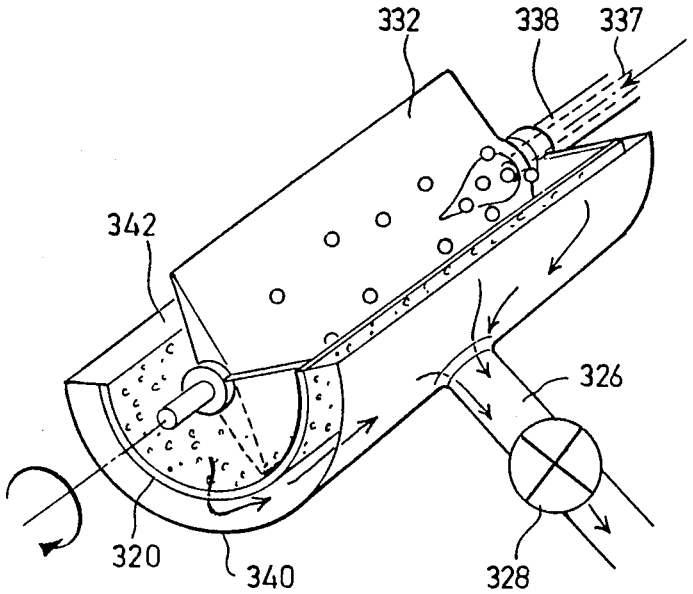
FIG 4c

CLEANING SYSTEM FOR FLUID-CONDUCTING TUBING

BACKGROUND OF THE INVENTION

The present invention relates to a cleaning system for cleaning fluid-conducting tubing. The invention is particularly useful in a condenser for cleaning the tubing of the heat-exchanger used in such a condenser, and the invention is therefore described below with respect to this application.

One of the known ways of cleaning the tubing of a condenser is by circulating through the tubing rubber balls which are slightly larger in diameter than the tubing so that they are compressed as they travel the length of the tubing. The constant rubbing action of the balls against the inner sides of the tubing keeps the tubing walls clean and free from deposits. Generally, the balls are circulated with the fluid through the tubing from its upstream side to its downstream side and are separated at the downstream side of the tubing, from where they are recirculated back to the upstreamside of the tubing by a continuously-driven pump. Examples of the known systems are described in U.S. Pat. Nos. 1,795,348, 2,801,824, 3,021,117, 3,872,920, 4,234,993, 4,350,202, 4,420,038 and 4,556,102. We have found, however, that in such recirculation means the continuously-driven pump is very troublesome and is highly susceptible to malfunctioning, and therefore such systems usually require considerable down-time for maintenance and repair purposes.

BRIEF SUMMARY OF THE INVENTION

An object of the present invention is to provide a novel cleaning system having advantages in the above respects.

According to the present invention, there is provided a novel cleaning system for cleaning tubing used for conducting a fluid therethrough, which system includes balls circulated with the fluid through the tubing from its upstream side to its downstream side, separator means for separating the balls from the fluid at the downstream side of the tubing, and recirculating means for recirculating the balls back to the upstream side of the tubing. In the novel system, the recirculating means comprises a chamber; a first passageway from the chamber to the downstream side of the tubing where the balls are separated from the fluid; a second passageway leading from the chamber to the atmosphere; a valve in the second passageway effective when opened to produce, by the difference in pressure between the downstream side of the tubing and the atmosphere, a flow of the fluid and balls from the downstream side of the tubing to the chamber; a separator between the chamber and the second passageway to permit the fluid, but not the balls, to flow through the second passageway to the atmosphere; and an ejector effective during each operation thereof to positively push all the balls collected in the chamber to the upstream side of tubing.

The foregoing arrangement thus obviates the need for a separate pump and provides a considerable pressure difference for moving the balls from the downstream side of the tubing to the ball-collecting chamber where the ejector is located for ejecting the balls back to the upstream side of the tubing.

Since the balls do not pass through a continuously-operated pump, but rather periodically pass into a collecting chamber where they are periodically ejected, such a cleaning system is less sensitive to malfunctioning and requires less down-time for maintenance and repair purposes. In addition, since the balls are positively ejected back into the upstream side of the tubing, this step requires but a few seconds.

Further features and advantages of the invention will be apparent from the description below.

BRIEF DESCRIPTION OF THE DRAWINGS

The invention is herein described, by way of example only, with reference to the accompanying drawings wherein:

FIGS. 2*a*, 2*b*, 3*a*, 3*b* and 4*a*–4*c* illustrate three further embodiments of the invention including other constructions of ejector for ejecting the balls back to the upstream side of the condenser tubing, the ejector being shown in non-actuated condition in FIGS. 2*a*, 3*a* and 4*a*, and in its actuated condition in FIGS. 2*b*, 3*b* and 4*b*, FIG. 4*c* being an enlarged three-dimensional view of the ejector of FIGS. 4*a* and 4*b*.

DESCRIPTION OF PREFERRED EMBODIMENTS

Figure 1A:
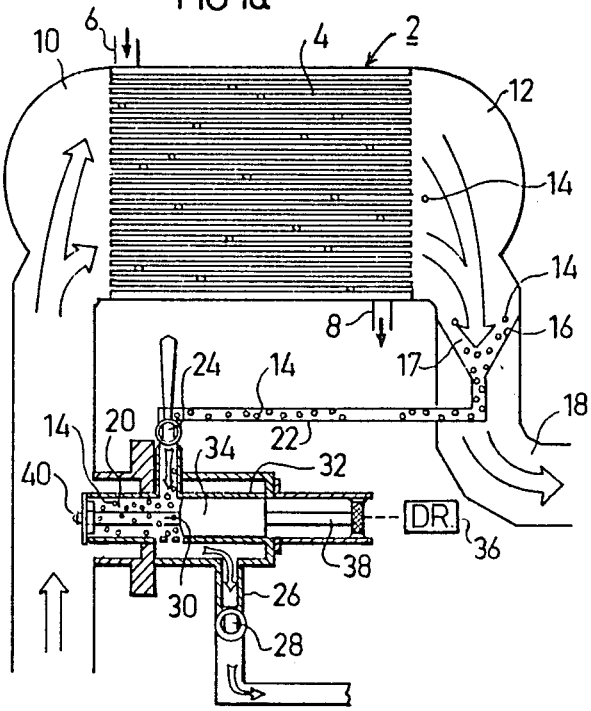
FIGS. 1*a*, 1*b* illustrate a first embodiment of the invention in the form of a condenser equipped with a cleaning system including an ejector for recirculating the balls back to the upstream side of the condenser tubing, the ejector being shown in its non-actuated condition in FIG. 1*a* and in its actuated condition in FIG. 1*b;*
Figure 1B:
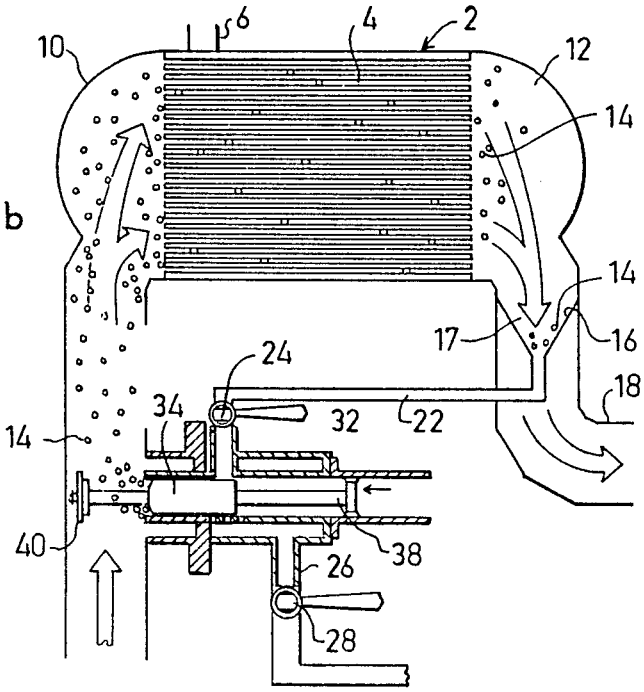

The Embodiment of FIGS. 1*a* and 1*b*

With reference to the embodiment illustrated in FIGS. 1*a*, 1*b*, this embodiment comprises a condenser, generally designated 2, including tubing 4 in the form of a plurality of parallel, spaced tubes, through which the cooling fluid, such as cooling water, is passed in order to condense a fluid, such as steam or a refrigerant gas, circulated from an inlet 6 through the spaces between the condenser tubing 4 to an outlet 8. The cooling liquid is circulated through the condenser tubing 4 from an inlet header 10 at tee upstream side of the condenser tubing to an outlet header 12 at the downstream side.

In order to prevent the lodging or settling of particles within the condenser tubing 4 which tend to clog or erode the tubing, the cooling liquid includes a plurality of cleaning balls 14 forced through the tubing 4 with the cooling liquid. Balls 14 are slightly larger in diameter than the condenser tubes 4 so that they rub against the inner walls of the tubes and thereby maintain them clean. Thus, any solid particles suspended in the cleaning liquid are kept moving and not allowed to settle, thereby preventing clogging of the tubes. This technique of using cleaning balls for cleaning the tubing in condensers and other forms of heat-exchangers is well known, and therefore further details of such a cleaning system, or of the balls 14 used in this type of system, are not set forth herein.

In the conventional cleaning system, the outlet header 12 includes a separator or strainer in the form of a conical screen 16 in region 17 at the downstream side of the condenser tubing 4. Screen 16 separates the cleaning balls 14 from the cooling liquid, as the cooling liquid passes through separator 16 to the cooling liquid outlet 18. The cleaning balls 14 thus separated by separator 16 are recirculated by a continuously-driven pump (not shown in FIG. 1*a*) back into the inlet header 18 for recirculation through the condenser tubing 4. As mentioned earlier, such conventional systems including a continuously-driven pump for recirculating the cleaning balls back to the inlet header at the upstream side of the condenser tubing are prone to malfunctioning, and therefore generally require by significant down-time for maintenance and repair purposes.

FIGS. 1*a* and 1*b* illustrate a cleaning system having an arrangement for recirculating the cleaning balls 14 back to the inlet header 10 at the upstream side of the condenser tubing 4 in a manner which obviates the need for a continuously-driven pump, and which thereby avoids the problems usually present in systems including such pumps.

Thus, the cleaning system illustrated in FIGS. 1*a*, 1*b* includes a chamber 20 connected by a passageway 22 to the region 17 at the downstream side of the condenser tubing 4 in which the cleaning balls 14 are collected. Passageway 22 includes a valve 24 controlling the flow from region 17 to chamber 20. Chamber 20 is connected by a second passageway 26 to the atmosphere, or to another point of lower pressure than that in region 17, the flow through passageway 26 being controlled by a second valve 28. Chamber 20 includes a separator screen 30 on the wall thereof adjacent to passageway 26 for separating the balls 14 from the cooling liquid. Thus, when both valves 24 and 28 are opened, the pressure difference between that in region 17 of the condenser, and the outlet end of passageway 26, produces a flow of the liquid from region 17 through passageway 22 into chamber 20 and out through the chamber via passageway 26. The balls 14 within this liquid are separated by screen 30 and collect within chamber 20.

Chamber 20 includes an ejector, generally designated 32, which is periodically actuated for injecting the balls 14 collected within chamber 20 into the cooling liquid passing into the inlet header 10 at the upstream side of the condenser tubing 4 for recirculation through the tubing. In the arrangement illustrated in FIGS. 1*a* and 1*b*, ejector 2 is of the reciprocating type, including a displaceable member or plunger 34 which is periodically reciprocated by any suitable drive, schematically indicated by box 36, to eject the balls 14 collected within chamber 20 into the cooling liquid passing into the inlet header 10. Thus, plunger 34 includes a stem 38 connected at one end to drive 36 and extended at the opposite end where it is connected to an end disc 40 which in the non-actuated position of plunger 34, as shown in FIG. 1*a*, closes the respective end of chamber 20. In this normal, non-actuated position of the ejector plunger 34, the balls 14 are separated by the screen 30 from the cooling liquid passing through the chamber and are collected within the chamber. When plunger 34 is actuated by drive 36, the balls are ejected through the open end of chamber 20 into the cooling liquid introduced into the inlet header 10.

The operation of the system illustrated in FIGS. 1*a* and 1*b* will be apparent from the above description. Thus, during the normal operation of the condenser, ejector plunger 34 is in the position illustrated in FIG. 1*a*, and both the valves 24 and 28 are closed. Accordingly, during the operation of the condenser the cleaning balls 14 forced through the condenser tubing 4 are separated by screen 16 and collect within region 17 at the downstream side of the condenser tubing 4.

Periodically, or whenever it is desired to recirculate the balls back to the upstream side of the condenser tubing 4, both valve 24 and 28 are opened so as to produce a flow of the cooling liquid, together with balls 14, from region 17, through passageway 22, chamber 20 and passageway 26. The balls 14 in the cooling liquid are separated by screen 30 and collect within chamber 20. Valve 24, and 28 are then closed, and the ejector plunger 34 is actuated by drive 36, as shown in FIG. 1*b*, so that the plunger 34 ejects the balls 14 collected within chamber 20 into the cooling liquid introduced into the inlet header 10 at the upstream side of the condenser tubing 4, to thereby recirculate the balls through the tubing. As soon as the balls have been thus ejected into the inlet header 10, plunger 34 is returned to its normal position as illustrated in FIG. 1*a*.

The operation of the valves 24, 26 for collecting another batch of balls 14 within chamber 20, and the operation of ejector 32 for ejecting the so-collected batch of balls back into the inlet header 10, may be done manually as desired, or may be done automatically e.g., in response to sensing the accumulation of a predetermined number of balls 14 within region 17.

Figure 2A:
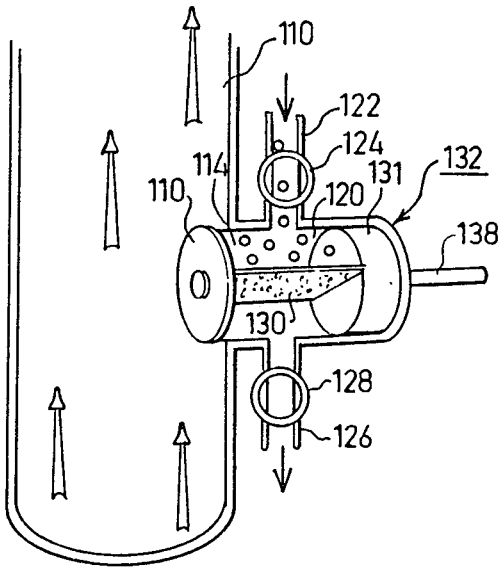
Figure 2B:
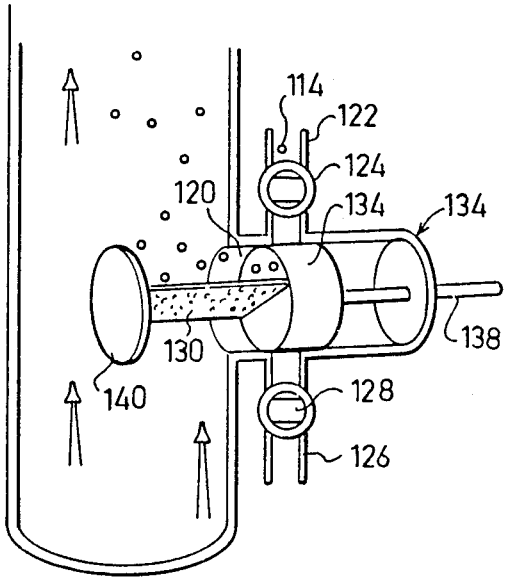

The Embodiment of FIGS. 2*a* and 2*b*

FIGS. 2*a*, 2*b* illustrate another construction of the ejector, therein designated 132, for periodically ejecting the balls accumulating within the ball-collecting chamber 120 into the inlet header 110 at the upstream side of the condenser tubing. The ejector 132 illustrated in FIGS. 2*a* is also of the reciprocating type, including a plunger 134 carried by a stem 138 and actuated by a drive (not shown). Stem 138 also carries a cover plate 140 which in the normal, non-actuated position of the ejector as shown in FIG. 2*a*, closes the outlet end of chamber 120.

In the arrangement illustrated in FIGS. 2*a* and 2*b*, however, the screen therein designated 130, for separating the balls 114 from the cooling liquid flowing via passageway 122 and 126 when both valves 124 and 128 are open, is used for connecting the closure plate 140 to the plunger 134. Thus, in the normal, non-actuated condition of the ejector 132 as shown in FIG. 2*a*, the balls 114 collect within chamber 120 at the side of screen 130 adjacent to the inlet passageway 122; and when the plunger 134 is actuated, the so-collected balls are ejected into the inlet header 110 as shown in FIG. 2*b*.

The Embodiment of FIGS. 3*a* and 3*b*

FIGS. 3*a* and 3*b* illustrate another construction of ejector, genarally designated 232, for periodically ejecting the balls 214 accumulating within the collecting chamber 220 into the inlet header 210 for the tubing 204 of the condenser 202. The ejector 232 illustrated in FIGS. 3*a* and 3*b* is also of the reciprocating type, but in this case the displaceable member, therein designated 234, is in the form of a diaphragm connected to a stem 238 actuated by a suitable drive for ejecting the balls 214 into the inlet header 210. Diaphragm 234 is formed with apertures 235 for separating the balls from the cooling liquid and for collecting them within the ball-collecting chamber 220. Thus, the diaphragm 234 also serves the function of the separator (corressponding to separator 30 in FIGS. 1*a*, 1*b* or separator 130 in FIGS. 2*a*, 2*b*) for separating the balls 214 from the cooling liquid passing through chamber 220 via passageways 222 and 226 when the two valves 224 and 228 are open.

Diaphragm 234 is secured within a housing 237. The inlet passageway 222 passes through diaphragm 234 so as to communicate with the interior of the housing 237 at one side of the diaphragm, whereas the outlet passageway 226 communicates with the interior of the housing at the opposite side of the diaphragm. The closure plate 240 carried at the end of stem 238 defines, with diaphragm 234, the ball-collecting chamber 220 for receiving the balls 214 separated from the cooling liquid separated by conical screen 216 in the condenser outlet header and passing to the collecting chamber 220 when the two valves 224 and 228 are open, as shown in FIG. 3*a*. When the ejector 232 is actuated, as shown in FIG. 3*b*, the balls collected within chamber 220 are forced by the diaphragm 234 into the inlet header 210 for recirculation through the condenser tubing in the same manner as in the above-described embodiments.

The Embodiment of FIGS. 4*a*–4*c*

FIGS. 4*a*, 4*b* and 4*c* illustrate another ejector structure, therein designated 332, including a rotary actuator, rather than a reciprocatable plunger, for ejecting the balls collected within a chamber, therein designated 230, into the inlet header of the condenser tubing. In the ejector illustrated in FIGS. 4*a* and 4*b*, when the two valves 324 and 328 are both opened, the cooling liquid is collected at the downstream side of the condenser tubing (in region 17, FIGS. 1*a*, 1*b*), and also includes the balls 314. This cooling liquid, with the balls, is directed via a passageway 337 formed through stem 338 of the rotary actuator 334 into chamber 320.

Housing 340, in which actuator 334 is rotatably mounted, is formed with one wall 341 which is perforated in order to separate the balls from the cooling liquid and thereby to collect the balls within chamber 320; the perforated wall 341 of housing 340 is at that side of the housing communicating with the outlet passageway 326. The opposite side 342 of housing 340 is open, and communicates with the inlet header at the upstream side of the condenser tubing.

Thus, when it is desired to recirculate the balls from the downstream side of the condenser tubing (region 17, FIGS. 1*a*, 1*b*), the two valves 324 and 328 are opened. The cooling liquid carrying the balls 314 is directed via passageway 337 stem 338 into chamber 320 where the balls are separated by the perforated side 341 of the housing 340 and accumulate within chamber 320; the cooling liquid passes through the perforated side 341 of the housing into the outlet passageway 326. When it is desired to eject the balls back into the upstream side of the condenser tubing, actuator 334 is actuated so as to be rotated to the position illustrated in FIG. 4*b*, whereby it moves the collected balls through the open side 342 of the housing 340 into the inlet header at the upstream side of the condenser tubing for recirculation through the tubing.

While the invention has been described with respect to several preferred embodiments, it will be appreciated that these are set forth purely for purposes of example, and that many other variations, modifications and applications of the invention may be made.

What is claimed is:

1. A cleaning system for cleaning tubing used for conducting a fluid therethrough, which system includes balls circulated with the fluid through the tubing from its upstream side to its downstream side, means for separating the balls from the fluid at the downstream side of the tubing, and recirculating means for recirculating the balls back to the upstream side of the tubing; characterized in that said recirculating means comprises a chamber; a first passageway from said chamber to the downstream side of the tubing where the balls are separated from the fluid; and second passageway leading from said chamber to the atmosphere; a valve in said second passageway effective when opened to produce, by the difference in pressure between said downstream side of the tubing and the atmosphere, a flow of the fluid and balls from said down stream side of the tubing to said chamber; a separator between said chamber and said second passageway to permit the fluid, but not the balls, to flow through said second passageway to the atmosphere; and an ejector effective during each operation thereof to positively push all the balls collected in said chamber into the upstream side of said tubing.

2. The cleaning system according to claim 1, wherein said first passageway also includes a valve which is opened with the valve in said second passageway.

3. The cleaning system according to claim 1, wherein said ejector comprises a displaceable member which is periodically reciprocated in said chamber to periodically eject the balls collected therein to the upstream side of the tubing.

4. The cleaning system according to claim 3, wherein said displaceable member comprises a reciprocatable plunger.

5. The cleaning system according to claim 4, wherein said separator includes a screen fixed in said chamber adjacent to the outlet thereof to said second passageway.

6. The cleaning system according to claim 4, wherein said separator includes a screen fixed to said plunger as to be reciprocated therewith.

7. The cleaning system according to claim 3, wherein said displaceable member comprises a diaphragm secured in a housing and defining said chamber therewith, said diaphragm being formed with openings so that the diaphram also serves as said separator for separating the balls from the fluid, and being reciprocatable to eject the balls within the chamber to the upstream side of the tubing.

8. The cleaning system according to claim 1, wherein said ejector comprises a rotary actuator rotatably mounted within a housing defining said chamber, said housing including said separator on one side connected to second passageway, and an opening on the opposite side connected to said upstream side of the tubing through which the balls are ejected upon the actuation of the rotary actuator.

9. The cleaning system according to claim 1, wherein said tubing includes a plurality of spaced tubes connected to an inlet header at the upstream side, and an outlet header at the downstream side, said outlet header including said separator means for separating the balls from the fluid exiting therefrom, and said inlet header receiving the balls ejected by said ejector from said chamber.

10. The cleaning system according to claim 9, wherein said tubing is part of a heat-exchanger in a condenser.

11. A cleaning system for cleaning tubing used for conducting a fluid therethrough by circulating balls with the fluid through the tubing from its upstream side to its downstream side; means for separating the balls from the fluid at the downstream side of the tubing; and recirculating means for recirculating the balls back to the upstream side of the tubing; said recirculating means comprising a chamber; a first passageway from said chamber to the down stream side of the tubing where the balls are separated from the fluid; a second passageway leading from said chamber to the atmosphere; a valve in said second passageway effective when opened to produce, by the difference in pressure between said downstream side of the tubing and the atmosphere, a flow of the fluid and balls from said downstream side of the tubing to said chamber; a separator between said chamber and said second passageway to permit the fluid, but not the balls, to flow through said second passageway to the atmosphere; and ejector effective during each operation thereof to positively push all the balls collected in said chamber to the upstream side of said tubing, said ejector comprising a displaceable member which is periodically reciprocated in said chamber to periodically eject the balls collected therein to the upstream side of the tubing.

12. The cleaning system according to claim 11, wherein said displaceable member comprises a reciprocatable plunger.

13. The cleaning system according to claim 12, wherein said separator means includes a screen fixed in said chamber adjacent to the outlet thereof to said second passageway.

14. The cleaning system according to claim 12, wherein said separator means includes a screen fixed to said plunger as to be reciprocated therewith.

15. The cleaning system according to claim 11, wherein said displaceable member comprises a diaphragm secured in a housing and defining said chamber therewith, said diaphragm being formed with openings so that the diaphram also serves as said separator for separating the balls from the fluid, and being reciprocatable to eject the balls within the chamber to the upstream side of the tubing.

16. A cleaning system for cleaning tubing used for conducting a fluid therethrough, which system includes balls circulated with the fluid through the tubing from its upstream side to its downstream side, means for separating the balls from the fluid at the downstream side of the tubing, and recirculating means for recirculating the balls back to the upstream side of the tubing; characterized in that said recirculating means comprises a chamber; a first passageway from said chamber to the downstream side of the tubing where the balls are separated from the fluid; a second passageway leading from said chamber to the atmosphere; a valve in said second passageway effective when opened to produce, by the difference in pressure between said downstream side of the tubing and the atmosphere, a flow of the fluid and balls from said downstream side of the tubing to said chamber; a separator between said chamber and said second passageway to permit the fluid, but not the balls, to flow through said second passageway to the atmosphere; and an ejector effective during each operation thereof to positively push all the balls collected in said chamber into the upstream side of said tubing; said ejector comprising a rotary actuator rotatably mounted within a housing defining said chamber, said housing including said separator on one side connected to second passageway, and an opening on the opposite side connected to said upstream side of the tubing through which the balls are ejected upon the actuation of the rotary actuator.

17. The cleaning system according to claim 16, wherein said tubing includes a plurality of spaced tubes connected to an inlet header at the upstream side, and an outlet header at the downstream side, said outlet header including said separator means for separating the balls from the fluid exiting therefrom, and said inlet header receiving the balls ejected by said ejector from said chamber.

18. The cleaning system according to claim 16, wherein said first passageway also includes a valve which is opened with the valve in said second passageway.

* * * * *